US005726451A

United States Patent [19]

Ishida et al.

[11] Patent Number: 5,726,451

[45] Date of Patent: Mar. 10, 1998

[54] SCAN TYPE FIRE DETECTING APPARATUS

[75] Inventors: Hiroshi Ishida; Akira Asoma; Yuzo Izaki, all of Tokyo, Japan

[73] Assignee: Hochiki Corporation, Tokyo, Japan

[21] Appl. No.: 510,569

[22] Filed: Aug. 2, 1995

[30] Foreign Application Priority Data

Aug. 2, 1994 [JP] Japan ..... 6-181134

[51] Int. Cl.[6] ..... G08B 17/12

[52] U.S. Cl. ..... 250/339.15; 250/342

[58] Field of Search ..... 250/339.15, 342

[56] References Cited

U.S. PATENT DOCUMENTS

| | | | |
|---|---|---|---|
| 4,671,362 | 6/1987 | Odashima | 169/61 |
| 4,749,862 | 6/1988 | Yoshida et al. . | |
| 4,800,285 | 1/1989 | Akiba et al. . | |

FOREIGN PATENT DOCUMENTS

| | | |
|---|---|---|
| A1260005 | 9/1988 | Germany . |
| 53-139590 | 12/1978 | Japan . |
| 61-38428 | 2/1986 | Japan . |
| 61-38430 | 2/1986 | Japan . |
| 546599 | 7/1993 | Japan . |
| A2193572 | 2/1988 | United Kingdom . |

*Primary Examiner*—Constantine Hannaher

*Attorney, Agent, or Firm*—Sughrue, Mion, Zinn, Macpeak & Seas, PLLC

[57] ABSTRACT

A scan type fire detecting apparatus is provided with a scanning unit which stepwise scans a monitoring area in a horizontal direction and vertically scans at each step of the horizontal scan to output a detecting signal obtained during the vertical and horizontal scan while a fire judging section judges an occurrence of a fire based on the detecting signal from the scanning unit. The fire judging section includes a first fire judging section which judges as to whether or not the detecting signal outputted from the scanning unit during the vertical and horizontal scanning is higher than a predetermined threshold value, and stops the horizontal scan of the scanning unit when the detecting signal is higher than the predetermined threshold value. A second fire judging section vertically scans the scanning area at the horizontal stop position, determined by the first fire judging section, and analyzes a frequency of the detecting signal detected through the vertical scan to judge whether or not the detecting signal is on the basis of a fluctuation of a flame, to thereby determine an occurrence of a fire when it is judged that the detecting signal is on the frequency of the fluctuation of a flame.

23 Claims, 11 Drawing Sheets

SCAN TYPE FIRE DETECTING APPARATUS

BACKGROUND OF THE INVENTION

1. Field of the Invention

The present invention relates to a scan type fire detecting apparatus for detecting a fire in a relatively broad monitoring area by a two-dimensional scan type fire detector installed at a relatively high location.

2. Description of the Related Art

In this type of the scan type fire detecting apparatus, a two-dimensional scan type fire detector including an infrared rays detector is installed at a relatively high location. This detector is stepwise moved in the horizontal direction, and the mirror is rotated in the vertical direction. In this way, a relatively broad area is scanned in a two-dimensional direction.

An example of this type of the scan type fire detecting apparatus is disclosed in Published Examined Japanese Patent Application (KOKOKU) No. Hei. 5-46599 and U.S. Pat. No. 4,749,862. A known method for detecting a fire is a method in which infrared rays emitted from flames in a fire are sensed, and when a sensing signal reaches a preset level, it is judged that a fire occurs. A known non-scan type fire detecting method is a method in which a flicker (fluctuation) peculiar to a flame at a fixed location is detected.

Another fire detecting apparatus which uses a visible ray detector in addition to the infrared detector in order to prevent a mistaken fire detection caused by the sunlight or light by illumination is disclosed in Published Unexamined Japanese Patent Application Nos. Sho. 53-139590, 61-38428, and 61-38430.

The scan type fire detecting apparatus merely sensing infrared rays from a flame has a problem of a mistaken fire detection caused by the sunlight or light by illumination. The fire detecting apparatus additionally using a visible ray detection is large and expensive. The method which detects only a fluctuation peculiar to a flame at a fixed location also has the problem of the mistaken fire detection. An attempt to detect the fluctuation of a flame while the fire monitoring area is two-dimensionally scanned results in complexity of the apparatus construction.

SUMMARY OF THE INVENTION

It is an object of the present invention to provide a small and cheap scan type fire detecting apparatus which exactly detects a fire when a fire monitoring area is two-dimensionally scanned.

A scan type fire detecting apparatus of the present invention is provided with a scanning unit which stepwise scans a monitoring area in a horizontal direction and vertically scans at each step of the horizontal scan to output a detecting signal obtained during the vertical and horizontal scan; and a fire judging section which judges an occurrence of a fire based on the detecting signal from the scanning unit. The fire judging section includes first fire judging section which judges as to whether or not the detecting signal outputted from the scanning unit during the vertical and horizontal scanning is higher than a predetermined threshold value, and stops the horizontal scan of the scanning unit when the detecting signal is higher than the predetermined threshold value; and second fire judging section which vertically scans the scanning unit at the horizontal stop position determined by the first fire judging section, analyzes a frequency of the detecting signal detected through the vertical scan to judge as to whether or not the detecting signal is on the basis of a fluctuation of a flame, and judges an occurrence of a fire when it is judged that the detecting signal is on the basis of the fluctuation of the flame.

In the present invention, the first fire judgement unit stops the scan of the fire detecting unit in the horizontal direction when the detecting signal is higher than the threshold value, and the second fire judgement unit scans the fire detecting unit in the vertical direction at the horizontal scan stop position to judge as to whether or not the frequency of the detecting signal represents the fluctuation of the flame (the frequency is within the range of 1 Hz to 10 Hz). Accordingly, through the two-dimensional scan of the fire monitoring area, two fire judgement are made; one based on the level of the detecting signal and the other based on the frequency thereof to ensure an exact fire detection. Further, the fire can exactly be detected with a simple construction.

BRIEF DESCRIPTION OF THE DRAWINGS

In the accompanying drawings.

PREFERRED EMBODIMENTS OF THE INVENTION

The preferred embodiment of the present invention will be described with reference to the accompanying drawings.

Figure 1:
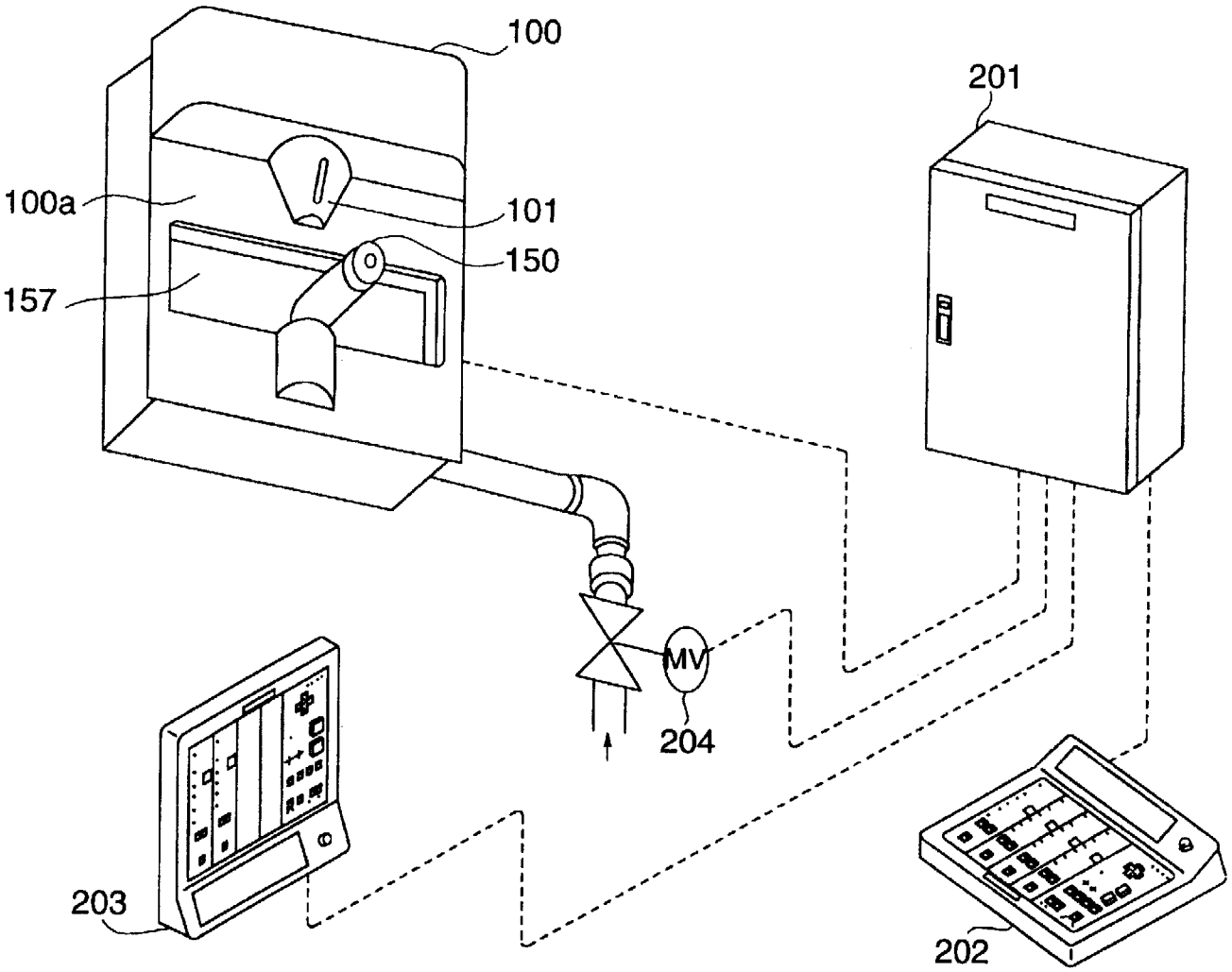
FIG. 1 is an external view showing an embodiment of a fire system containing a scan-type fire detector/fire apparatus according to the present invention.

FIG. 1 is an external view showing an embodiment of a fire system containing a scan-type fire detector/fire apparatus according to the present invention.

Figure 2:
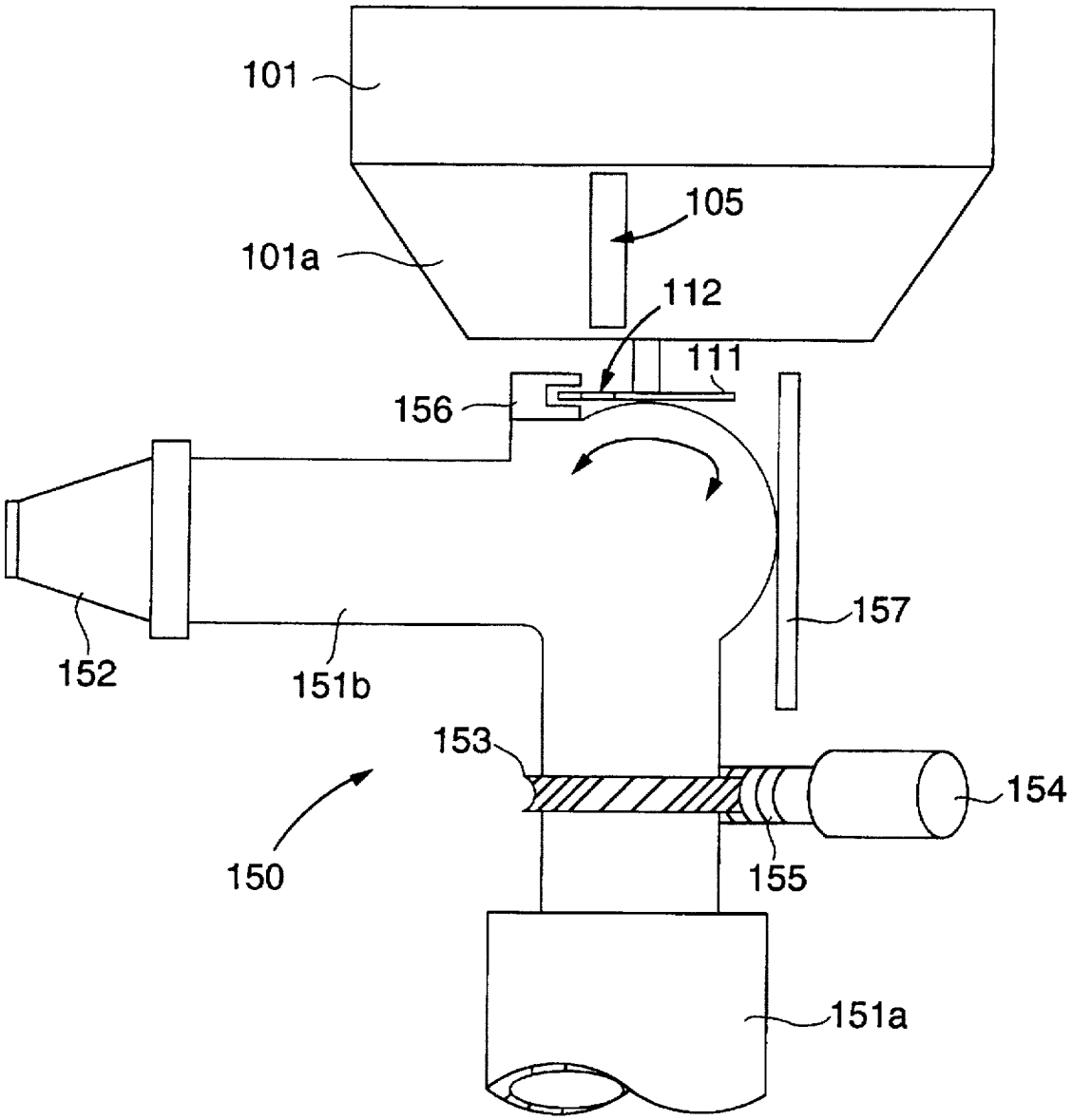
FIG. 2 is a side view showing a structural relationship between a scan type fire detector unit and a water-discharging nozzle.

As shown in FIG. 1, the fire system includes a main unit case 100, a control board 201, a central operation unit 202 installed in a building manager's office or the like and a local operation unit 203 installed in the vicinity of the main unit 100. As shown in detail in FIG. 2, the main unit case 100 includes a 2-dimensional scan type fire detecting unit 101 and a water-discharging unit 150 which are coaxially arranged when viewed in the vertical direction. These units 100 and 150 may independently be swung in the horizontal direction.

Figure 3A:
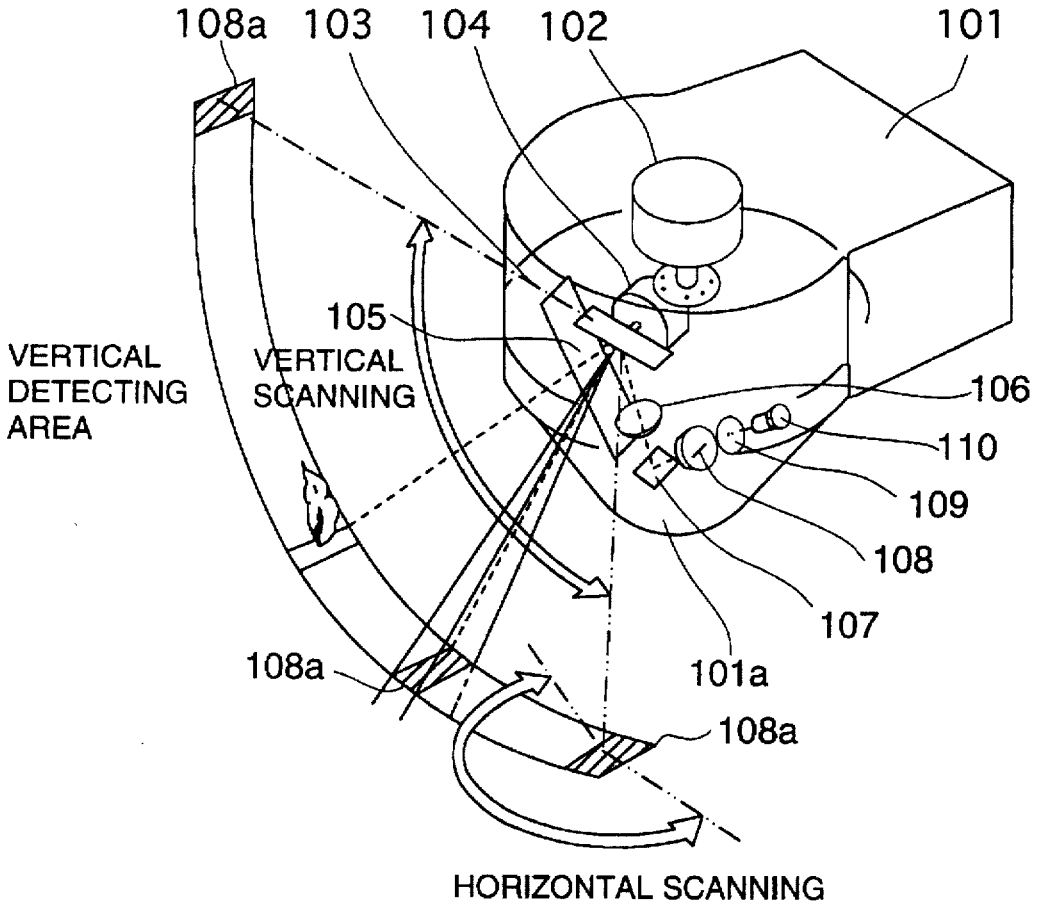
FIG. 3A is a view showing the construction of a scan type fire detector unit.

The 2-dimensional scan type fire detecting unit 101 is based on the known technique for detecting a flame by one wavelength in the infrared region. The fire detecting unit 101 is provided with a swing section to be described later. The swing section is slightly protruded frontward from the front wall 100*a* of the main unit case 100. The swing section is capable of horizontally scanning an area within about 190°. As shown in FIG. 3A, a conical swing section 101*a* located on the lower side of the fire detecting unit 101 is horizontally and stepwise swung within the range of 190°, for example, in a reciprocal manner with respect to the main unit case 100 by a horizontal scan motor 102 as a pulse motor. A rotary mirror 103, both sides of which is formed of mirrors, is rotated in a clockwise direction in FIG. 3B at an equiangular speed by a vertical scan motor 104 as a DC motor. The rotary mirror scans an instantaneous visual field within the range from an area just under the main unit case 100 to a right-angle direction (90)° therefrom in the vertical direction. The instantaneous visual field is determined by the slit 108.

Figure 3B:
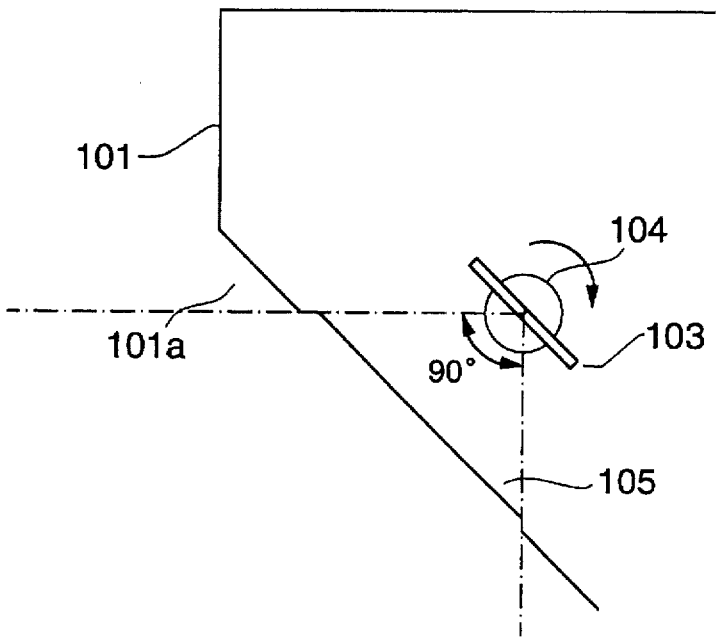
FIG. 3B is a sectional view of the scan type fire detector unit.

Infrared-rays emitted from a monitoring area is restrained within a range defined by a window 105 in a range of 90° as shown in FIG. 3B. The infrared-rays, after passing the window 105, is reflected by the rotary mirror 103, imaged by an objective 106, and reflected by a reflection mirror 107. An instantaneous visual field 108*a* is determined by a slit 108. The infrared-rays is converged onto the receiving surface of an infrared-rays sensor 110 by a condenser lens 109. The instantaneous visual field 108*a* means a monitor visual field on the presumption that the rotary mirror 103 is at a standstill.

Returning to FIG. 2, a disc 111 is fixed under the swing section 101*a* located on the lower side of the fire detecting unit 101. In this case, the disc 111 is arranged coaxially with the swing section 101*a*, and horizontally rotatable together therewith. The disc 111 has an opening 112. The Opening 112 of the disc 111 and the opening window 105 are arranged in the same direction (the horizontal direction of the rotary mirror 103 when it vertically scans). Accordingly, the opening 112 is always directed in the horizontal direction of the rotary mirror 103. The water-discharging unit 150 is formed with a vertical pipe 151*a* and an L-shaped pipe 151*b*. The vertical pipe 151*a* is vertically fixed to the main unit case 100, with the opening end thereof being directed upward. The L-shaped pipe 151*b*, which is L shaped when viewed from the side thereof, is provided with a water discharging nozzle 152 firmly attached to the front end thereof. The L-shaped pipe 151*b* is rotatable with respect to the upper end, opened, of the vertical pipe 151*a*. The L-shaped pipe 151*b* has a vertical portion, one end of which is connected to the vertical pipe 151*a*, and a horizontal portion, one end of which is connected to the water discharging nozzle 152. As shown in FIG. 1, the vertical pipe 151*a* is connected with a sprinkler pipe, for example, by way of an electrically driven valve 204.

A worm 153 is coaxially fixed on the outer surface of the L-shaped pipe 151*b*. The worm 153 is in mesh with a worm wheel 155 which is mounted on the shaft of a nozzle drive motor 154. The nozzle drive motor 154 is fixed to the main unit case 100. When the nozzle drive motor 154 is turned, the L-shaped pipe 151*b* and the water discharging nozzle 152 at the front end of the L-shaped pipe 151*b* are swung horizontally.

A photo interrupter 156 is attached to the upper side of the L-shaped pipe 151*b* in the same direction as of the water discharging nozzle 152. The photo interrupter 156 includes a light emitting element and a photo sensing element. The peripheral part of the disc 111 of the swing section 101*a*, which is on the lower side of the fire detecting unit 101, passes through an opening between the light emitting element and the photo sensing element. A detecting signal is produced when the opening 112 of the disc 111 is coincident in position with the photo interrupter 156, viz., when the direction of the water discharging nozzle 152 is coincident with the horizontal direction of the rotary mirror 103 when it scans in the vertical direction. The photo interrupter 156 may be substituted by a limit switch, for example.

A cover 157 is mounted on the side of the L-shaped pipe 151*b* which is opposite to a side where the water discharging nozzle 152 is provided. As illustrated in detail in FIG. 4A, when the water discharging nozzle 152 is directed opposite to the front side and housed in the main unit case 100, the cover 157 is flush with the front wall 100*a* of the main unit case 100. As illustrated in detail in FIGS. 4B and 4C, when the water discharging nozzle 152 and the L-shaped pipe 151*b* are horizontally turned, the cover 157 is also turned. In a water-discharging state that the water discharging nozzle 152 and the L-shaped pipe 151*b* are projected from the front wall 100*a*, the cover 157 is housed in the main unit case 100.

Figure 5:
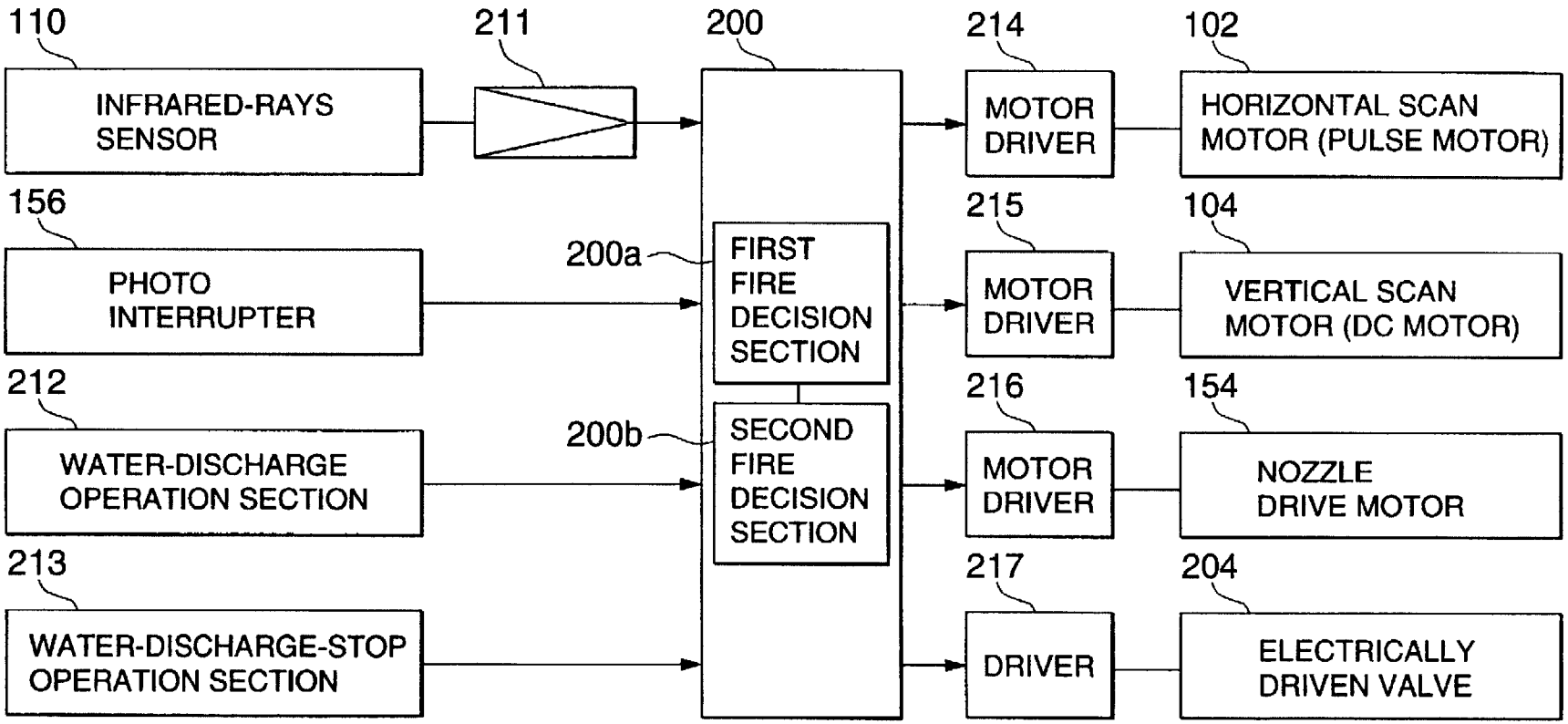
FIG. 5 is a block diagram showing a control system for the fire detecting/extinguishing apparatus.

A control system of the fire detecting apparatus thus mechanically constructed will be described with reference to FIG. 5. A control unit 200 includes a first fire judgement section 200*a* and a second fire judgement section 200*b*. The control unit 200 receives an amplified signal outputted from an amplifier 211 where a sensing voltage from the infrared-rays sensor 110 is amplified, a detecting signal, from the photo interrupter 156, a water-discharging signal from the water-discharge operation section 212, and a water-discharge-stop signal from a water-discharge-stop operation section 213. A water-discharge operation section 212 and the water-discharge-stop operation section 213 are both contained in the central operation unit 202, and also in the local operation unit 203 shown in FIG. 1. In response to these signals, the control unit 200 controls the horizontal scan motor 102, vertical scan motor 104, nozzle drive motor 154, and the electrically driven valve 204, through the drivers 214 to 217 associated therewith, respectively.

Figure 6:
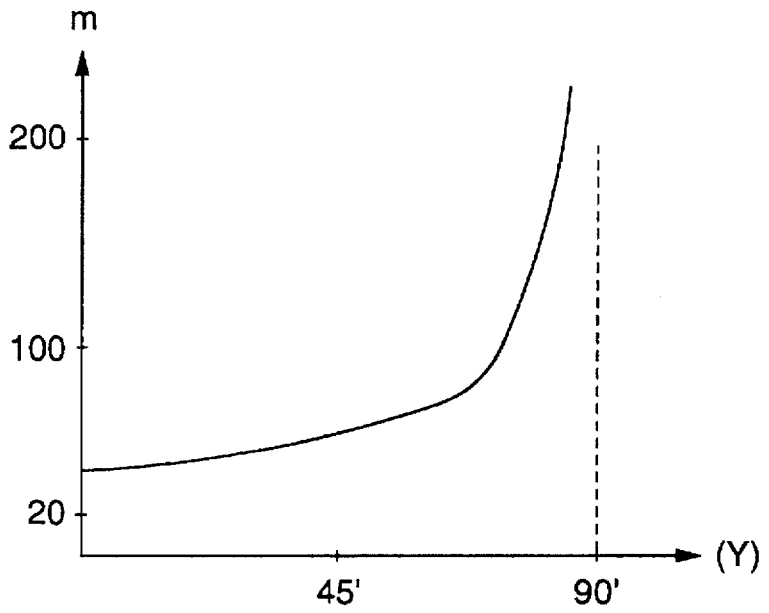
FIG. 6 is a graph showing a relationship between a vertical scan angle and a scan distance corresponding thereto.
Figure 7:
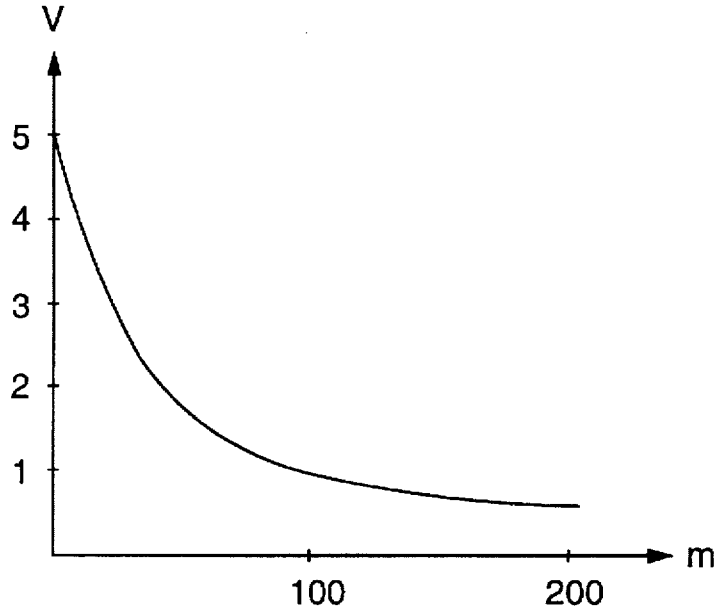
FIG. 7 is a graph showing a variation of a fire judgement level with respect to the vertical scan distance.
Figure 8:
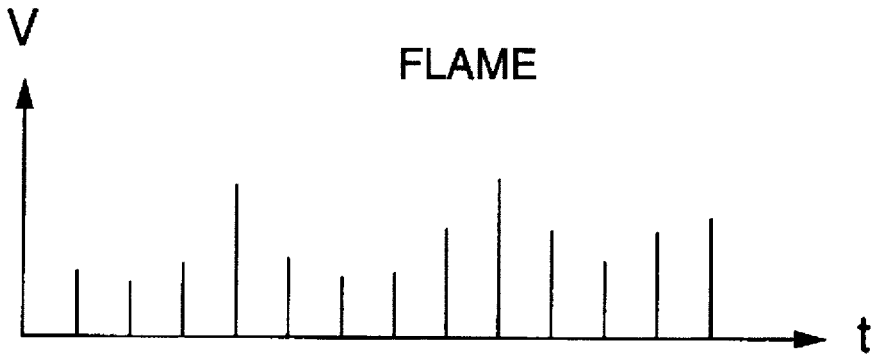
FIG. 8 is a diagram showing a fluctuation of a flame.
Figure 9:
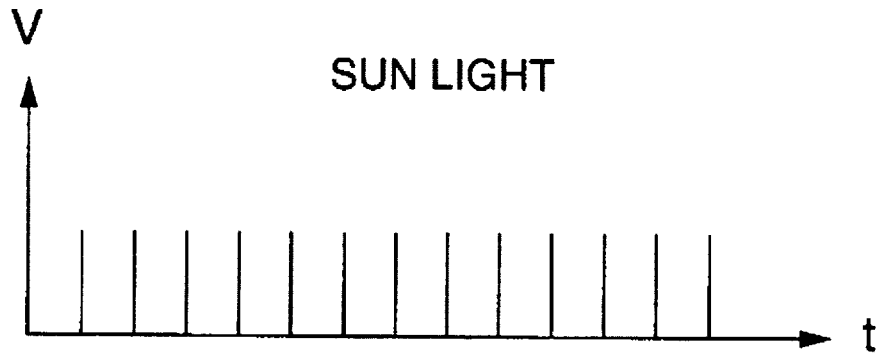
FIG. 9 is a diagram showing static light free from a fluctuation.

The rotary mirror 103 of the fire detecting unit 101 rotates at an equiangular speed to scan in the vertical direction. To convert the scan angle into the corresponding scan distance in the horizontal plane, data on the scan distance (m) for each vertical (Y) scan angle is stored in advance in a memory of the control unit 200. An example of the relationship between the scan distance and the scan angle is shown in FIG. 6. In this Case, the data is stored in the form of a table. The control unit 200 makes its correction so that the scan of the rotary mirror 103 is performed at a uniform speed. A voltage V produced by the infrared-rays sensor 110, when it senses flames, decreases as the distance of the flames increases from the sensor, as shown in FIG. 7. In consideration of this fact, a threshold voltage Vth which depends on distance (m) is previously stored in the memory of the control unit 200. A flame fluctuates with time t at a frequency as shown in FIG. 8, usually 1 to 10 Hz. Consequently, a time-sequentially varying detecting voltage V produced from the infrared-rays sensor 110 varies while it senses the infrared-rays at the same point in the vertical direction. On the other hand, when the light is the sunlight or light by illumination, the detecting voltage V from the infrared-rays sensor 110 is invariable with time t, as shown in FIG. 9.

Figure 10:
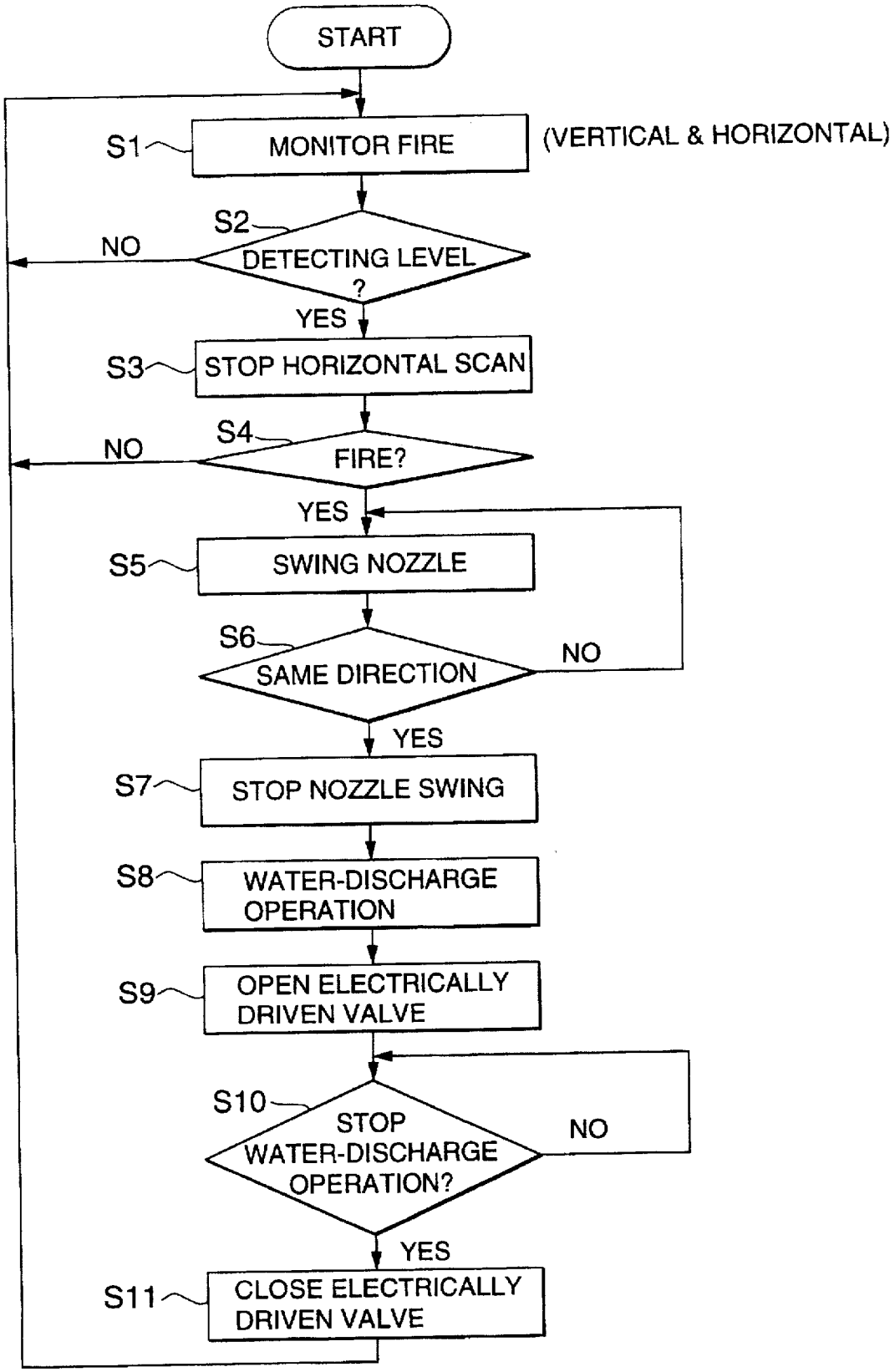
FIG. 10 is a flowchart showing the operation of the scan type fire detecting apparatus.

The operation of the control unit 200 will be described with reference to a flowchart shown in FIG. 10. In a loop of steps S1→S2→S1, the horizontal scan motor 102 is rotated stepwise and reciprocatively so that the fire detecting unit 101 is horizontally turned. The vertical scan motor 104 is driven to rotate the rotary mirror 103 for the vertical scan at a equiangular speed. Through the operation, the first fire judgement section 200*a* monitors the detecting voltage V of the infrared-rays sensor 110. In a first fire monitoring mode (in a loop of steps S1→S2→S1), the vertical scan motor 104 is rotated at a relatively slow speed, for example;, 5–6 turns/sec. in order to impede its performance deterioration.

If a voltage V higher than the threshold value Vth as shown in FIG. 7 corresponding to the distance is detected in the first monitor mode thus performed two-dimensionally, the first fire judgement section 200*a* stops only the horizontal scan motor 102 to stop the horizontal scanning, and the first fire judgement mode monitored by the first fire monitoring section 200*a* is transferred to a second fire monitoring mode monitored by the second fire judgement section 200*b*. At this time, the second fire judgement section 200*b* still rotates the vertical scan motor 104 at a speed capable of sampling the frequency of the fluctuation of a flame (step S3). Since both sides of the rotary mirror 103 are mirrors, the rotary mirror 103 samples the flame in the vertical direction at the rate of 16 times/sec. by rotating the vertical scan motor 104 at the speed of 8 rotations/sec. Accordingly, it is possible to detect the flame wavering at 8 Hz or lower according to the sampling theorem. To a further exact detection, the rotating speed of the vertical scan motor 104 is doubled to sample the flame at 32 times/sec. If so done, the fluctuation of a flame is detected at 16 Hz or lower.

To detect a flame by the vertical scan, the fluctuation of a flame is detected by analyzing a frequency based on a plurality of detecting signals which is obtained from a position in the vertical direction where the maximum output signal is detected in the first vertical scan.

Figure 4A:
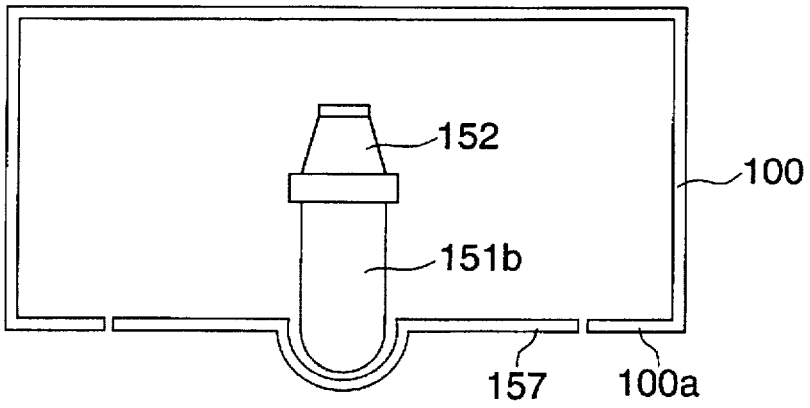
FIGS. 4A is a plan view showing a structural relationship between the water discharging nozzle and a cover associated therewith in a normal state.
Figure 4B:
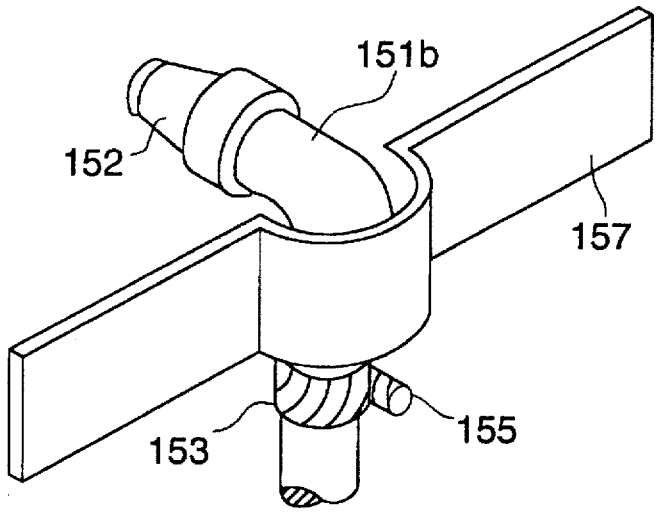
FIG. 4B is a perspective view of FIG. 4A.
Figure 4C:
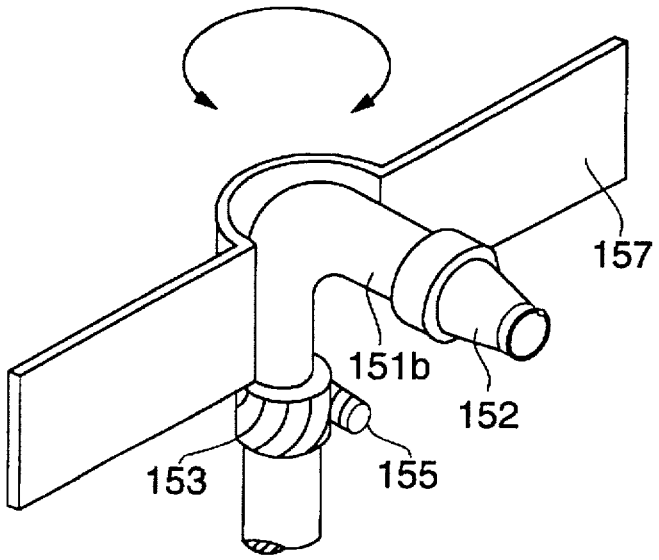
FIG. 4C is a perspective view showing a structural relationship between the water discharging nozzle and the cover in a fire state.

When the fluctuation of a flame is detected on the basis of the frequency analysis using data of the detecting signal as shown in FIG. 8, namely, the frequency is 1 Hz to 10 Hz, the second fire judgement section 200*b* judges that the sensed infrared-rays is emitted from a fire, viz., a fire has occurred, and advances from a step S4 to a step S5 and subsequent steps. When the sensed light is judged as static light such as the sunlight or light by illumination by using data of a detecting signal as shown in FIG. 9, it returns to the step S1, and restarts the fire monitoring operation in the first fire monitoring mode. In the step S5, a fire signal is sent to generate an alarm, while at the same time starts up the nozzle drive motor 154, thereby causing the water discharging nozzle 152 to turn from its initial state as shown in FIG. 4A. Then, the water discharging nozzle 152 which has been concealed by the cover 157 appears in front of the main unit case 100.

In the subsequent step S6, the control unit judges as to whether or not the water discharging nozzle 152 is directed in the same direction as of the fire detecting unit 101 on the basis of a detecting signal from the photo interrupter 156. If the directions of these components are different from each other, the control unit turns the water discharging nozzle 152 so that those components are directed in the same direction (step S7). The fire detecting unit 101 is stopped in the fire direction when viewed in the horizontal direction (step S3). Accordingly, the water discharging nozzle 152 also stops while being directed in the fire detecting direction. Then, a water discharging operation is conducted in the water-discharge operation section 212 to open the electrically driven valve 204 so as to allow water to be discharged through the water discharging nozzle 152 (step S8→step S9). When the water discharging is stopped by operating the water-discharge-stop operation section 213, the electrically driven valve 204 is closed to stop the water-discharging (step S10 to step S11).

In the above-mentioned embodiment, the fluctuation of a flame is detected in a manner that the frequency of the fluctuation is sampled by rotating the rotary mirror 103. Alternatively, an intensity level of infrared rays may be detected in a state that the rotary mirror 103 is at a standstill. Since a flame providing a maximum value of the detecting signal V has less fluctuation at the center of the flame, the rotary mirror 103 is stopped at a position within a range from a position which provides the maximum value of the detecting signal to another position where is located above the maximum value providing position and provides no detecting signal. An exact detection of the fluctuation is secured by analyzing a variation of the infrared rays level at the mirror stop position.

Figure 11A:
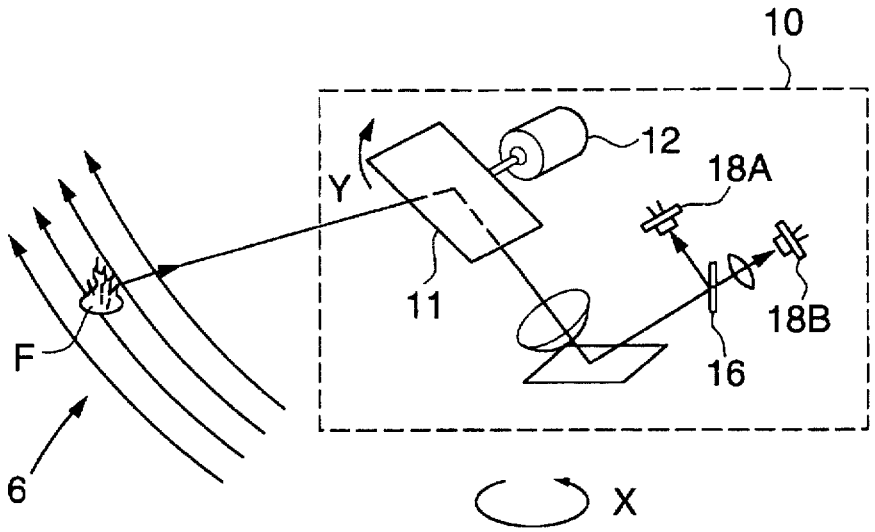
FIGS. 11A and 11B are diagrams showing a construction of a scan type fire detecting apparatus according to the present invention.
Figure 11B:
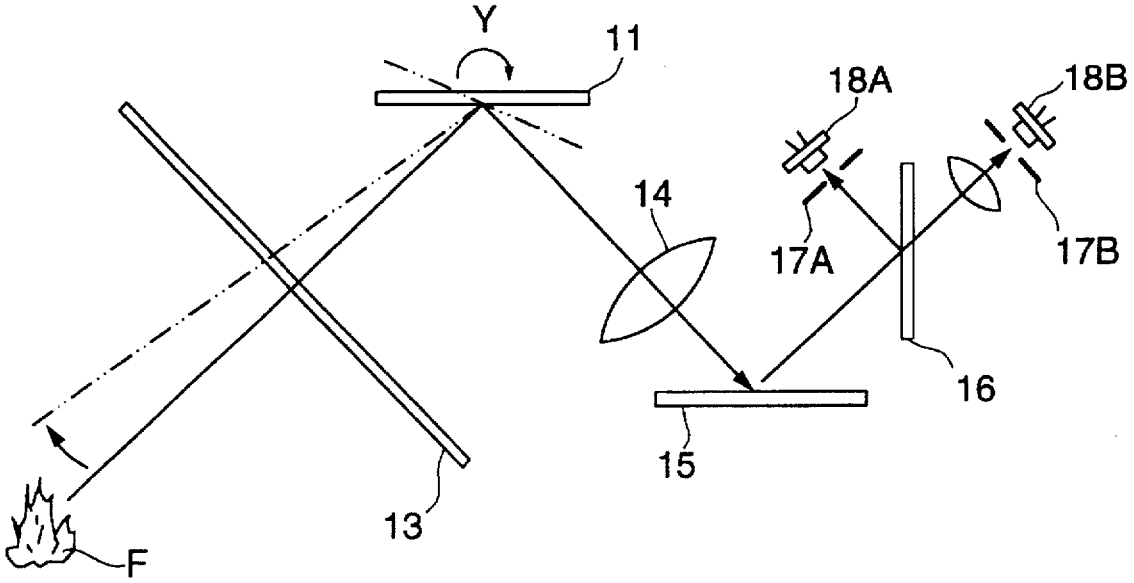
Figure 12:
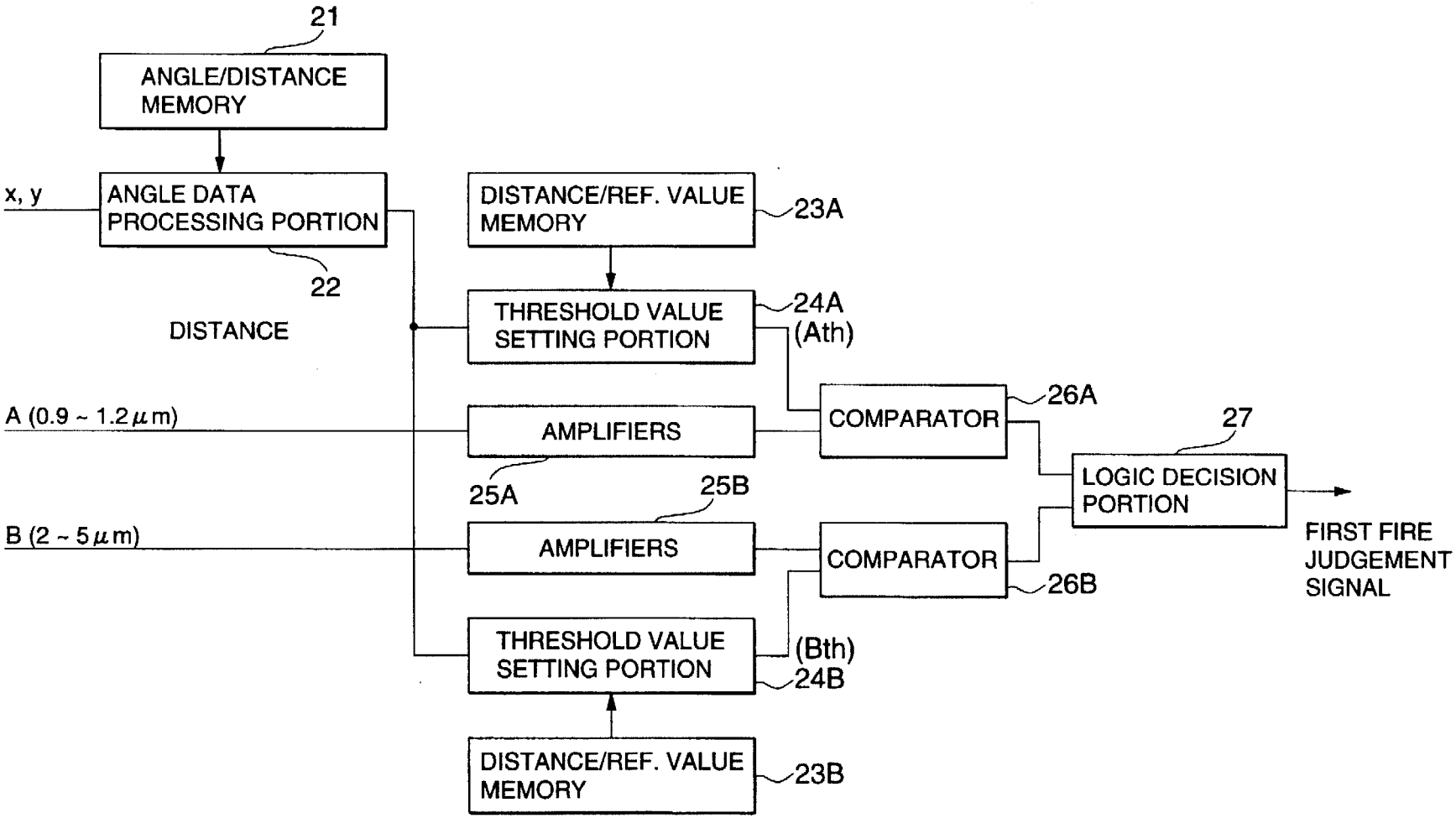
FIG. 12 is a block diagram showing a first fire judgement unit in the scan type fire detecting apparatus of the second embodiment.

With respect to the fire judgement section 200*a*, a second embodiment according to the present invention will be described with reference to FIGS. 11 to 13. The first embodiment detects only the infrared rays level in the loop of the steps S1→S2→S3 shown in FIG. 10, viz., a first fire monitor mode (first fire judgement unit). The second embodiment of the present invention is arranged such that both the infrared rays level and the sunlight level are detected by a two-wavelength method in the first fire monitor mode.

A construction of a fire detector will be described with reference to FIGS. 11A to 11B. In FIG. 11A, a two-dimensional scan type detector 10 is enclosed by a dotted line block. It may be swung in the steps of a preset angle in the horizontal (x) direction in a fire monitoring area 6, for example, within a range of 190°. A rotary mirror 11 in the two-dimensional scan type detector 10 is rotatable by a drive motor 12 for scanning over the fire monitoring area 6 in the vertical (Y) direction. By the rotation of the rotary mirror 11, the fire monitoring area 6 is vertically scanned. Radiation from any point within the monitoring area passes through a protecting window 13, reflected by the rotary mirror 11, converged by a lens 14, and directed to a band-pass filter 16 by a full reflection mirror 15.

The band-pass filter 16 allows light of approximately 1.5 μm or longer in wavelength to pass therethrough, but reflects light of shorter than 1.5 μm. A square slit 17A and a photo sensor 18A sensitive to light rays of a relatively narrow range of wavelengths, 0.9 to 1.2 μm are located in an optical path of light rays reflected by the band-pass filter 16. A square slit 17B and a photo sensor 18B sensitive to light rays of a relatively broad range of wavelengths, 2.0 to 4.5 μm are located in an optical path of light rays transmitted through the band-pass filter 16. The dynamic range of the photo sensor 18A for the short wavelengths is narrow so that the size of the square slit 17A is preferably equal to or slightly larger than that of the square slit 17B. Short wave and long wave detecting signals derived from the respective photo sensors 18A and 18B are outputted to a signal processing circuit as shown in FIG. 12. These signals are used for a first fire judging process by the two-dimensional fire monitoring operation.

Figure 13:
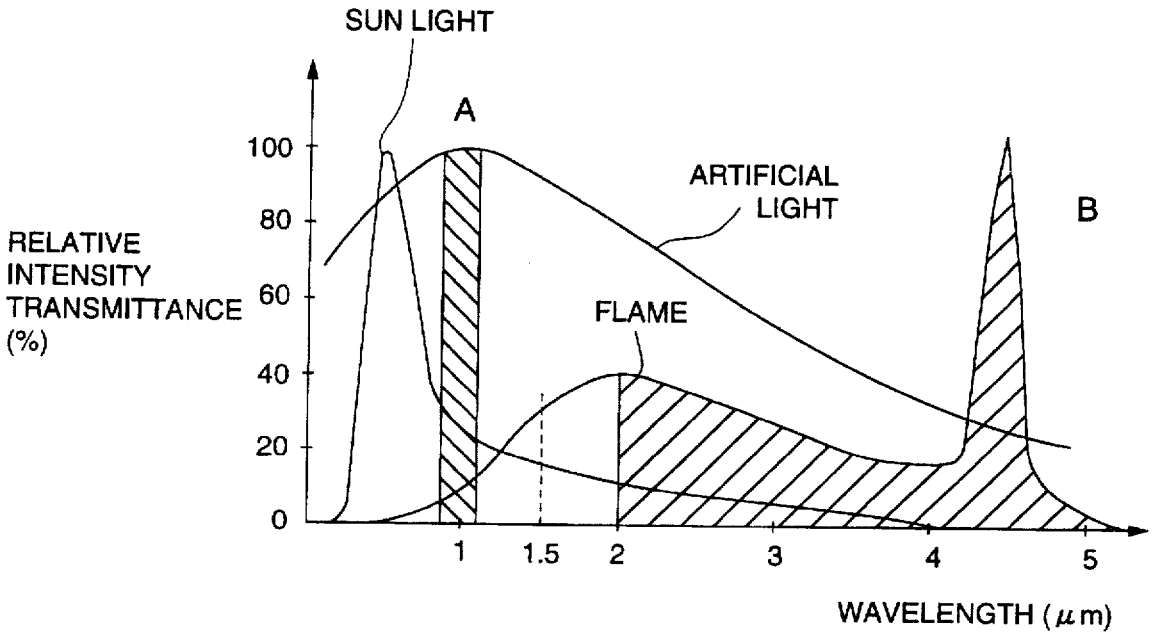
FIG. 13 is a graph showing spectral distributions of the sunlight, artificial light, and a flame.

As shown in FIG. 13, light from a flame is distributed over a broad wavelength range from 1 to 5 μm and has a peak value of the relative intensity transmittance at the wavelength of about 4.3 μm. Its relative intensity transmittance is negligible at the wavelength of about 1 μm. The sunlight has a peak value in the visible rays of blue to red, and is distributed over the wavelengths of longer than those of the visible rays. The artificial light is peaked at the wavelength of about 1 μm, and distributed over a broad range of wavelengths from ultraviolet rays to far infrared rays. Its distribution curve is gentle. In the present embodiment, infrared rays emitted from a flame are sensed in a relatively broad range of wavelengths, 2.0 to 4.5 μm, and the sunlight and light by a lamp are sensed in a relatively narrow range of wavelengths, 0.9 to 1.2 μm.

The diameter of particles contained in a smoke from a fire is 0.1 μm or shorter. Light transmitted through the smoke is scattered and attenuated in inverse proportion to the fourth power of the wavelength in accordance with Rayleigh's law. Accordingly, in the case of light having the wavelength of 0.5 μm, its scattering and attenuation are sixteen times as much as of light of 1 μm. Accordingly, it is preferable to use light of 0.9 to 1.2 μm, longer than the visible rays to exactly sense light coming from a distant place.

The signal processing circuit of the present embodiment will be described with reference to FIG. 12. Scan distance values every vertical scan angle as shown in FIG. 6 are previously stored in an angle/distance memory 21. An angle data processing portion 22 repeatedly reads out the distance data every time the two-dimensional scan type detector 10, moving in the horizontal (X) direction, is stopped every preset angle. The readout distance data is outputted to threshold value setting portions 24A and 24B for short and long waves. The scan distance for each vertical scan angle is previously determined by the height of the installed two-dimensional scan type detector 10, and every vertical scan angle. Accordingly, the uniform angular speed scan by the rotary mirror 11 at a uniform angular speed is converted into a uniform speed scan on the horizontal plane.

Threshold values Ath and Bth for discriminating detecting signals A and B every vertical scan distance as shown in FIG. 7 are previously stored in distance/threshold value memories 23A and 23B, respectively. The threshold values Ath and Bth are respectively read out by the threshold value setting portions 24A and 24B in accordance with the vertical scan distance, and inputted to comparators 26A and 26B, respectively. Incidentally, if a fire monitoring area 6 is an imperfect plane in which there are irregularities due to the wall and/or something placed thereon and the distance from the fire detecting apparatus to an object to be detected is not uniform, or if an intensive radiation may be probably based by any other cause than a fire, the influences of such a situation have to be taken into consideration when the threshold values Ath and Bth are determined.

The detecting signals A and B detected by the photo sensors 18A and 18B (FIG. 11) are amplified at the gains depending on the sensitivities of the photo sensors 18A and 18B, the visual fields of the slits 17A and 17B and the like, and outputted to the comparators 26A and 26B, respectively. The comparator 26A produces a disturbance light detecting signal when the detecting signal A is larger than the threshold value Ath. Similarly, the comparator 26B produces a fire detecting signal when the detecting signal B is larger than the threshold value Bth. A logic judgement portion 27 produces no first fire judgement signal when it receives a disturbance light detecting signal and additionally receives a fire detecting signal, and produces a first fire judgement signal when it receives no disturbance light detecting signal but receives a fire detecting signal.

Thus, the second embodiment detects infrared rays of light radiated from a fire F in a relatively broad range of wavelength from 2.0 to 4.5 μm, when the first fire judgement is made. Therefore, the detecting signal B produced is high in S/N ratio even if the detection distance is long. The sunlight and light by a lamp are sensed in a relatively narrow range of wavelengths, 0.9 to 1.2 μm. Disturbance light, such as the sun light or artificial light, can exactly be detected with less attenuation thereof, which results from the scattering by fine mist in an atmosphere and particles in the smoke.

Also in the present embodiment, the disturbance light detecting signal A and the fire detecting signal B are respectively compared with the threshold values Ath and Bth. Because of this, the second embodiment can exactly detect disturbance light and a fire irrespective of the distance. Further, the embodiment determines a flicker of a flame after the comparing process. Because of this, a reliable fire detection is ensured.

In the above described embodiments, the control section 200 may be provided in the control panel 201 or main unit case 100. Further, a part of the control section 200 may be provided in the control panel 201, and other part may be provided in the main unit case 100. For example, the fire detecting unit in the main unit case controls the horizontal and vertical scan, and the whole of controls and judgements accompanying with the fire detecting such as a fire judgement, and remaining controls are conducted in the control panel. Further, it may be considered that the control section is provided only in the main unit case 100.

What is claimed is:

1. A scan type fire detecting apparatus comprising:

scanning means for stepwise scanning monitoring area in a horizontal direction and vertically scanning at each step of the horizontal scan to output a detecting signal obtained during the vertical and horizontal scan; and fire judging means for judging an occurrence of a fire based on the detecting signal from said scanning means;

said fire judging means including:

first fire judging means for judging as to whether or not the detecting signal outputted from said scanning means during the vertical and horizontal scanning is higher than a predetermined threshold value, and stopping the horizontal scan of said scanning means when the detecting signal is higher than the predetermined threshold value; and second fire judging means for vertically scanning said scanning means at the horizontal stop position determined by said first fire judging means, analyzing a frequency of the detecting signal detected through the vertical scan to judge as to whether or not the detecting signal is on the basis of a fluctuation of a flame, and judging an occurrence of a fire when it is judged that the detecting signal is on the basis of the fluctuation of the flame, wherein a first vertical scan speed of said scanning means scanned by said first fire judging means is different from a second vertical scan speed of said scanning means scanned by said second fire judging means.

2. A scan type fire detecting apparatus according to claim 1, wherein said second fire judging means vertically scans said scanning means at a speed corresponding to the frequency of the fluctuation of the flame.

3. A scan type fire detecting apparatus according to claim 2, wherein the second vertical scan speed is faster than the first vertical scan speed.

4. A scan type fire detecting apparatus according to claim 1, wherein said second fire judging means determines the occurrence of the fire when the frequency is in a range of 1 to 10 Hz.

5. A scan type fire detecting apparatus according to claim 1, wherein said second fire judging means scans said scanning means at the horizontal stop position a plurality of times, and analyzes frequencies of a plurality of detecting signals from an instantaneous visual field where a maximum detecting signal is obtained at a first vertical scan to judge as to whether or not the detecting signals are on the basis of the flame.

6. A scan type fire detecting apparatus according to claim 5, wherein said second fire judging means determines the occurrence of the fire when the frequency is in a range of 1 to 10 Hz.

7. A scan type fire detecting apparatus according to claim 5, further comprising:

first detecting means for detecting infrared rays of light to output a first detecting signal;

second detecting means for detecting light the wavelength of which is shorter than that of the infrared rays;

wherein said first fire judging comprises:

first comparing means comparing the first detecting signal with a first threshold value, and outputting a fire detecting when the first detecting signal is larger than the first threshold value;

second comparing means for comparing the second detecting signal with a second value, and outputting a disturbance light detecting signal when the second detecting signal is larger than the second threshold value; and third fire judging meant for stopping the horizontal scan of said scanning means and outputting a first fire judgment signal to said second fire judging means when said first comparing means outputs the fire detecting signal and said second comparing means outputs no disturbance light detecting signal.

8. A scan type fire detecting apparatus according to claim 7, wherein said first detecting means detects the infrared rays in a wavelength from 2.0 to 4.5 μm, and said second detecting means detects the light in a wavelength from 0.9 to 1.2 μm.

9. A scan type fire detecting apparatus according to claim 7, wherein the first and the second threshold values correspond to a scanning distance in the vertical direction.

10. A scan type fire detecting apparatus according to claim 1, wherein said second fire judging means stops the vertical scan of said scanning means at any position, as the horizontal scan stop position determined by said first fire judging means, in a range of a maximum position where a maximum detecting signal is obtained to a position where is located above the maximum position and no detecting signal is obtained, and analyzes the frequency of the detecting signal to judge as to whether or not the detecting signal is on the basis of a fluctuation of a flame.

11. A scan type fire detecting apparatus, according to claim 10, wherein said second fire judging means determines the occurrence of the fire when the frequency is in a range of 1 to 10 Hz.

12. A scan type fire detecting apparatus according to claim 10, further comprising:

first detecting means for detecting infrared rays of light to output a first detecting signal;

second detecting means for detecting light the wavelength of which is shorter than that of the infrared rays;

wherein said first fire judging means comprises:

first comparing means for comparing the first detecting signal with a first threshold value, and outputting a fire detecting signal when the first detecting signal is larger than the first threshold value;

second comparing means for comparing the second detecting signal with a second threshold value, and outputting a disturbance light detecting signal when the second detecting signal is larger than the second threshold value; and third fire judging means for stopping the horizontal scan of said scanning means and outputting a first fire judgment signal to said second fire judging means when said first comparing means outputs the fire detecting signal and said second comparing means outputs no disturbance light detecting signal.

13. A scan type fire detecting apparatus according to claim 12, wherein said first detecting means detects the infrared rays in a wavelength from 2.0 to 4.5 μm, and said second detecting means detects the light in a wavelength from 0.9 to 1.2 μm.

14. A scan type fire detecting apparatus according to claim 12, wherein the first and the second threshold values correspond to a scanning distance in the vertical direction.

15. A scan type fire detecting apparatus according to claim 1, further comprising:

first detecting means for detecting infrared rays of light to output a first detecting signal;

second detecting means for detecting light the wavelength of which is shorter than that of the infrared rays;

wherein said first fire judging means comprises:

first comparing means for comparing the first detecting signal with a first threshold value, and outputting a fire detecting signal when the first detecting signal is larger than the first threshold value;

second comparing means for comparing the second detecting signal with a second threshold value, and outputting a disturbance light detecting signal when the second detecting signal is larger than the second threshold value; and third fire judging means for stopping the horizontal scan of said scanning means and outputting a first fire judgment signal to said second fire judging means when said first comparing means outputs the fire detecting signal and said second comparing means outputs no disturbance light detecting signal.

16. A scan type fire detecting apparatus according to claim 15, wherein said first detecting means detects the infrared rays in a wavelength from 2.0 to 4.5 μm, and said second detecting means detects the light in a wavelength from 0.9 to 1.2 μm.

17. A scan type fire detecting apparatus according to claim 15, wherein the first and the second threshold values correspond to a scanning distance in the vertical direction.

18. A scan type fire detecting apparatus comprising:

scanning means for stepwise scanning monitoring area in a horizontal direction and vertically scanning at each step of the horizontal scan to output a detecting signal obtained during the vertical and horizontal scan; and fire judging means for judging an occurrence of a fire based on the detecting signal from said scanning means;

said fire judging means including:

first fire judging means for judging as to whether or not the detecting signal outputted from said scanning means during the vertical and horizontal scanning is higher than a predetermined threshold value, and stopping the horizontal scan of said scanning means when the detecting signal is higher than the predetermined threshold value, said predetermined threshold value selected from a plurality of threshold values stored in a memory so that the predetermined threshold value selected corresponds to a calculated scan distance in the horizontal plane; and second fire judging means for vertically scanning said scanning means at the horizontal stop position determined by said first fire judging means, analyzing a frequency of the detecting signal detected through the vertical scan to judge as to whether or not the detecting signal is on the basis of a fluctuation of a flame, and judging an occurrence of a fire when it is judged that the detecting signal is on the basis of the fluctuation of the flame.

19. A scan type fire detecting apparatus comprising:

scanning means for stepwise scanning a monitoring area in a horizontal direction and vertically scanning at each step of the horizontal scan to output a detecting signal obtained during the vertical and horizontal scan; and fire judging means for judging an occurrence of a fire based on the detecting signal from said scanning means;

said fire judging means including:

first fire judging means for judging as to whether or not the detecting signal outputted from said scanning means during the vertical and horizontal scanning is higher than a predetermined threshold value, and stopping the horizontal scan of said scanning means when the detecting sisal is higher than the predetermined threshold value; and second fire judging means for vertically scanning said scanning means at the horizontal stop position determined by said first fire judging means, analyzing a frequency of the detecting signal detected through the vertical scan to judge as to whether or not the detecting signal is on the basis of a fluctuation of a flame, and judging an occurrence of a fire when it is judged that the detecting signal is on the basis of the fluctuation of the flame, wherein said second fire judging means stops the vertical scan of said scanning means at any position, as the horizontal scan stop position determined by said first fire judging means, in a range of a maximum position where a maximum detecting signal is obtained to a position where is located above the maximum position and no detecting signal is obtained, and analyzes the frequency of the detecting signal to judge as to whether or not the detecting signal is on the basis of a fluctuation of a flame.

20. A scan type fire detecting apparatus according to claim 19, wherein said second fire judging means determines the occurrence of the fire when the frequency is in a range of 1 to 10 Hz.

21. A scan type fire detecting apparatus according to claim 19, further comprising:

first detecting means for detecting infrared rays of light to output a first detecting signal;

second detecting means for detecting light the wavelength of which is shorter than that of the infrared rays;

wherein said first fire judging means comprises:

first comparing means for comparing the first detecting signal with a first threshold value, and outputting a fire detecting signal when the first detecting signal is larger than the first threshold value;

second comparing means for comparing the second detecting signal with a second threshold value, and outputting a disturbance light detecting signal when the second detecting signal is larger than the second threshold value; and third fire judging means for stopping the horizontal scan of said scanning means and outputting a first fire judgment sisal to said second fire judging means when said first comparing means outputs the fire detecting signal and said second comparing means outputs no disturbance light detecting signal.

22. A scan type fire detecting apparatus according to claim 21, wherein said first detecting means detects the infrared rays in a wavelength from 2.0 to 4.5 μm, and said second detecting means detects the light in a wavelength from 0.9 to 1.2 μm.

23. A scan type fire detecting apparatus according to claim 21, wherein the first and the second threshold values correspond to a scanning distance in the vertical direction.

* * * * *